US006371025B1

(12) United States Patent
Dufour et al.

(10) Patent No.: US 6,371,025 B1
(45) Date of Patent: Apr. 16, 2002

(54) APPARATUS AND METHOD FOR CLEANING A TUBULAR PRINTING BLANKET

(75) Inventors: Charles Henry Dufour, Durham, NH (US); David Crowell Emery, York, ME (US); Roland Thomas Palmatier, Durham, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/571,907

(22) Filed: May 16, 2000

(51) Int. Cl.[7] ..... B41F 35/06

(52) U.S. Cl. ..... 101/425; 101/423; 101/424; 15/256.52; 15/256.53

(58) Field of Search ..... 101/423, 424, 101/425, 375; 15/256.5, 256.51, 256.52, 256.3

(56) References Cited

U.S. PATENT DOCUMENTS 4,066,017 A * 1/1978 Garcowski et al. ..... 101/425
5,813,336 A 9/1998 Guaraidi et al. ..... 101/218
5,918,545 A * 7/1999 Pym ..... 101/424

* cited by examiner

*Primary Examiner*—John S. Hilten
*Assistant Examiner*—Kevin D. Williams
(74) *Attorney, Agent, or Firm*—Davidson, Davidson & Kappel, LLC

(57) ABSTRACT

An apparatus for cleaning a tubular printing blanket, comprises a first end cap mounted to a first end portion of the tubular printing blanket; a second end cap mounted to a second end portion of the tubular printing blanket, a compressed air inlet passing through the first end cap; a compressed air supply coupled to the compress air inlet for supplying compressed air to the inside of the tubular printing blanket for stiffening the tubular printing blanket during a cleaning operation; and a cleaning element which interacts with the outside surface of the tubular printing blanket, for cleaning the tubular printing blanket. A method for cleaning a tubular printing blanket comprises the steps of mounting end caps to the end portions of the tubular printing blanket for sealing the inside of the tubular printing blanket against ambient air; supplying compressed air to the inside of the tubular printing blanket for stiffening the tubular printing blanket; and cleaning the outside surface of the tubular printing blanket

11 Claims, 2 Drawing Sheets

3
5
7
2
17
39
40
41
8
6
4

3
2
39
4
41
40

2
39
4
41
40

APPARATUS AND METHOD FOR CLEANING A TUBULAR PRINTING BLANKET

BACKGROUND OF THE INVENTION

Field of the Invention

The invention relates to an apparatus and a method for cleaning a tubular printing blanket.

Offset lithographic web printing presses have printing units containing several cylinders rotating between side walls. The cylinders include a print cylinder carrying a print form having an image thereon and a blanket cylinder carrying a tubular printing blanket. The image is transferred from the print form to the blanket and from the blanket to the web.

Vertical and horizontal web offset presses having gapless tubular blankets may include on-press blanket washers. Such washers are typically integrated into the structure of the press. However, end users of web offset presses often do not purchase on-press blanket washers and therefore manual washing of the blankets must be performed. This results in down-time for the press and accordingly must be performed quicklet leaving little time for inspection. The tubes do not have time to "rest" and be rejuvenated, thus the use of chemicals on the press is required.

In addition, some presses have limited access for washing the blanket tubes and some washing chemicals are not recommended for use on the press. In such cases, the tubular blankets must be removed for cleaning. U.S. Pat. No. 5,813,336 discloses a printing unit from which print forms and tubular blankets can be removed through an opening in a side wall. The tubular blanket which is removed from the press is then installed into a cleaning station by mounting the tubular blanket on storage chucks. A typical cleaning process comprises rotating the tubular blanket, applying cleaning solution to the outer surface of the blanket and contacting and cleaning the outer surface with a rotating brush. The tubular blankets include an inner thin metal tube which tends to swing and deflect when rotated in the cleaning station and contacted by the rotating brush. This disadvantage increases with an increase of the diameter of the tubular blanket and leads to non-satisfactory cleaning results. Moreover, the interaction of the rotating brush and the flexible tube can further lead to non-elastic deformations of the tube.

SUMMARY OF THE INVENTION

It is accordingly an object of the invention to provide an apparatus and a method for cleaning a tubular printing blanket, which overcome the herinafore-mentioned disadvantages of the heretofore-known devices of this general type and which lead to proper cleaning results, specifically when cleaning large diameter tubular printing blankets.

With the foregoing and other object in view there is provided, in accordance with the invention, an apparatus for cleaning a tubular printing blanket, comprising a first end cap mounted to a first end portion of the tubular printing blanket;

a second end cap mounted to a second end portion of the tubular printing blanket; a compressed air inlet passing through the first end cap; a compressed air supply coupled to the compressed air inlet which supplies compress air to the inside of the tubular printing blanket for stiffening the tubular printing blanket during a cleaning operation; and a cleaning element interacting with the outside surface of the tubular printing blanket, for cleaning the tubular printing blanket.

The cleaning apparatus of the present invention has the advantage that the tubular printing blanket is stiffened by the compressed air during the cleaned operation, so that the cleaning element interacts with a resisting, non-swinging and hardly non-deflectable surface of the tubular printing blanket.

In accordance with another feature of the invention, the cleaning element is a rotating brush. In addition, the rotating brush may be rotated by a drive motor or manually by a crank.

In accordance with a further feature of the invention, the first end cap and the second end cap are rotatablay supported, i. e. in a housing of the cleaning apparatus, and one of the first end cap and the second end cap is driven by a drive motor. It is also possible to rotate the end caps manually, e. g. by using a crank.

In accordance with yet another feature of the invention, the rotating brush and the rotating end cap may be connected to a single drive motor via a gear drive.

Pursuant to a further embodiment of the invention, the apparatus comprises at least one cleaning solution applicator for applying cleaning solution to the tubular printing blanket. The cleaning solution applicator may include spray nozzles for applying the cleaning solution to the tubular printing blanket. The cleaning solution may be supplied by a cleaning solution supply.

In accordance with an another exemplary embodiment of the invention, the apparatus may comprise a waste collector disposed below the tubular printing blanket and the rotating brush for receiving the cleaning solution. The waste collector may be part of the housing of the apparatus.

In accordance with a further feature of the invention, a filter and treatment device for receiving the cleaning solution and selectively guiding or recirculating the cleaning solution back to the cleaning solution applicator may be provided. In this embodiment, the reticulation may be achieved via a cleaning solution supply line which also may include a pump.

In accordance with yet another embodiment of the invention, the apparatus may further comprise a biasing element for biasing the first end cap and the second end cap against the associated first end portion and second end portion of the tubular printing blanket. The biasing element may be a pneumatic cylinder or any known actuator, e. g. a lever mechanism with a resilient element acting on the end caps.

According to another embodiment, the biasing element includes a connecting element extending from the first end cap to the second end cap. The connecting element may include a threaded portion which interacts with a nut element arranged at one of the first or second end caps, for clamping the first and the second end cap to the associated end portions of the tubular printing blanket. The nut element may also be formed as an integral part of one of the end caps.

In accordance with a concomitant feature of the invention, the apparatus further comprises a sealing element which is located at the first end cap and preferably also at the second end cap, for sealing the inside of the tubular printing blanket against ambient air.

There is also provided, in accordance with the invention, a method for cleaning a tubular printing blanket, comprising the steps of: mounting end caps to the end portion so of the tubular printing blanket for sealing the inside of the tubular printing blanket against ambient air; supplying compressed air to the inside of the tubular printing blanket for stiffening the tubular printing blanket; and cleaning the outside surface of the tubular printing blanket.

Other features which are considered as characteristic for the invention are set forth in the appended claims.

Although the invention is illustrated and described herein as embodied in an apparatus and a method for cleaning a tubular printing blanket, it is nevertheless not inded to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
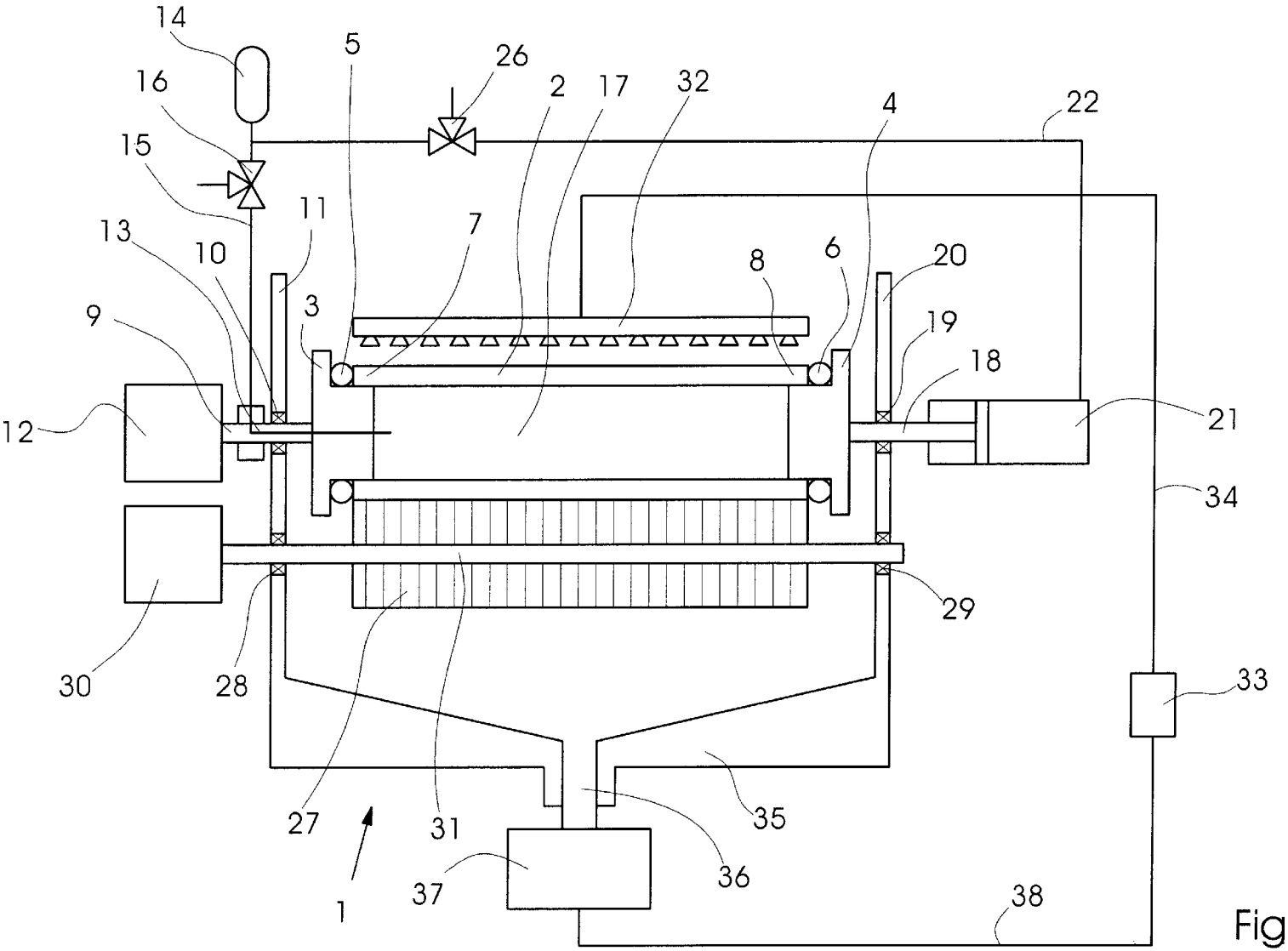
FIG. 1 is a schematic view of an apparatus for cleaning a tubular printing blanket.

Referring now to the figures of the drawings in detail, FIG. 1 shows a schematic view of an apparatus 1 for cleaning a tubular printing blanket 2. The apparatus 1 comprises a first end cap 3 and a second end cap 4 which are mounted to the tubular printing blanket 2. Sealing elements 5 and 6 are located between the first end cap 3 and a first end portion 7 of the tubular printing blanket 2 and between the second end cap 4 and a second end portion 8 of the tubular printing blanket 2 for sealing the inside of the tubular printing blanket 2 against ambient air.

End cap is connected to a shaft 9 which is rotatably supported by a bearing 10 in a side wall 11 of the apparatus 1 and which is connected to a drive motor 12 for rotating the installed tubular printing blanket 2 during the washing operation.

The shaft 9 and the end cap 3 are provided with a compressed air inlet 13 which may pass through at least a portion of the shaft 9 and through the first end cap 3. The compressed air inlet 13 is connected to a compressed air supply 14 via a compressed air supply line 15 and a two-way-valve 16. Depending on the position of the two-way-valve 16, the inside 17 of the tubular printing blanket 2 is supplied with compressed air in a first position of the valve 16 or the compressed air can escape from the inside 17 of the tubular printing blanket 2 on a second position of the valve 16. In the first position of the valve 16 the tubular printing blanket 2 is stiffened by the compressed air.

As can be further seen from FIG. 1, end cap 4 may be connected to a shaft 18 which is rotatably supported by a bearing 19 in a further side wall 20 of the apparatus 1 and which may be used as a piston rod is part of a pneumatic cylinder 21. If the pneumatic cylinder 21 is supplied with compressed air from the compress air supply 14 via a compressed air supply line 22 the shaft 18 and consequently the end cap 4 are biased against the tubular printing blanket thereby clamping the tubular printing blanket 2. If the two-way-vale 26 is opened the compressed air escapes from the pneumatic cylinder 21 and the end cap 4 can be moved back releasing the tubular printing blanket 2 for removing it from the apparatus 1.

A brush 27 is rotatably supported between the two side walls 11 and 20 of the apparatus 1 by bearings 28 and 29. A drive motor 30 is connected to the shaft 31 of the brush 27 for rotating the brush which contacts and cleans the outside surface of the tubular printing blanket 2.

A cleaning solution applicator 32 is associated with the rotating tubular printing blanket 2 and applies cleaning solution to the outer surface of the tubular printing blanket 2. The cleaning solution may be supplied from a cleaning solution supply 33 via a cleaning solution supply line.

The apparatus 1 further comprises a waste collector 35 which has an outlet 36 feeding the collected cleaning solution to a filter and treatment device 37. The cleaning solution is filtered and fed to the cleaning solution supply via a supply line 38. The supply lines 34 and 38 may additionally include a pump or the pump may be incorporated into the filter and treatment device 37 or the cleaning solution supply 33. Thus, the cleaning solution can be recirculated and reused in the apparatus 1.

Figure 2:
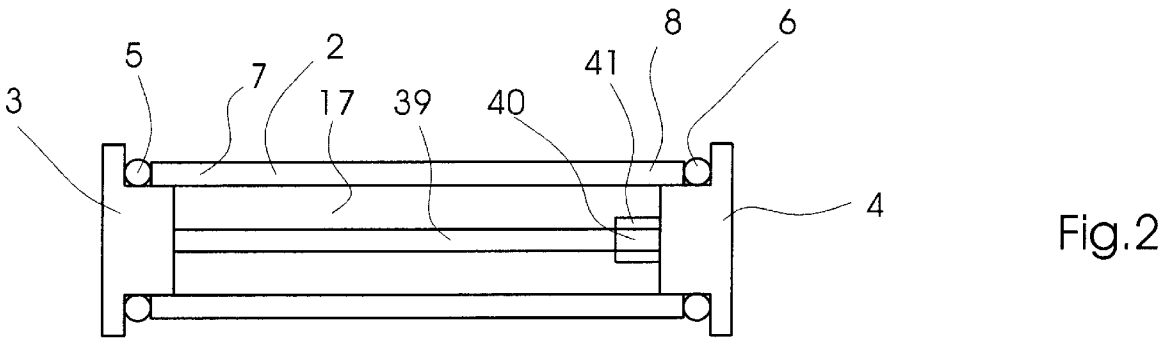
FIG. 2 is a cross-sectional view of a tubular printing blanket with end caps mounted thereon, in which the end caps are connected by a threaded rod and a nut element mounted at the inside of one of the end caps.

FIG. 2 is a cross-sectional view showing the tubular printing blanket 2 with two mounted end caps 3 and 4 which are sealed by sealing elements 5 and 6. A connecting element 39 is fixed to the first end cap 3 and extends from the first end cap 3 through the inside 17 of the tubular printing blanket 2 to the second end cap 4. The connecting element 39 includes a threaded portion 40. The second end cap 4 includes a nut element 41 fixed to the second end cap 4 at the inside of the tubular printing blanket 2 which interacts with the threaded portion 40 of the connecting element 39 for clamping the two end caps 3 and 4 to the associated end portions 7 and 8 of the tubular printing blanket 2. This may be achieved by rotating the second end cap 4, so as to screw the threaded portion 40 into the nut element 41.

Figure 3:
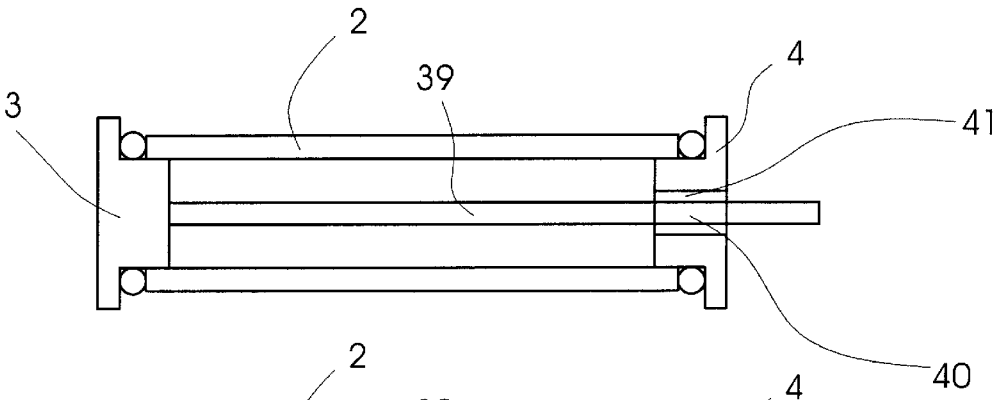
FIG. 3 is a cross-sectional view of a tubular printing blanket with end caps mounted thereon, in which the end caps are connected by a threaded rod which is received in a nut element which is formed as an integral part of one of the end caps.

FIG. 3 shows the second end cap 4 with an incorporated nut element 41 interacting with the threaded portion 40 of the connecting element 30.

Figure 4:
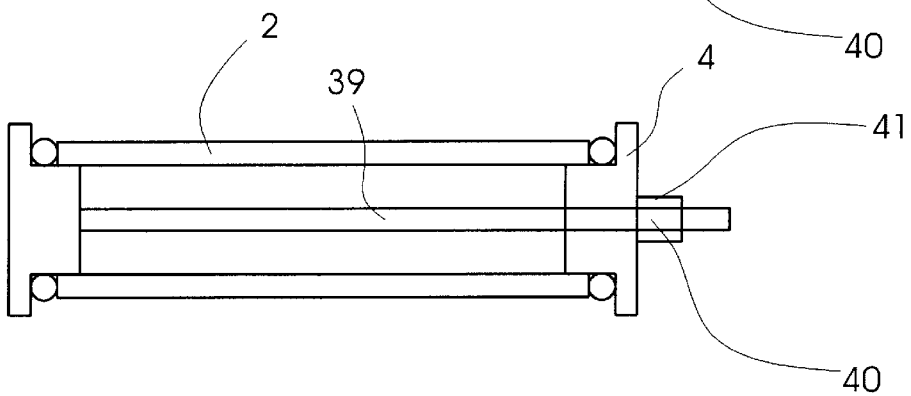
FIG. 4 is a cross-sectional view of a tubular printing blanket with end caps mounted thereon, in which the end caps are connected by a threaded rod and a nut element mounted at the outside of one of the end caps.

FIG. 4 shows the second end cap 4 including a nut element 41 fixed to the second end cap 4 at the outside of the tubular printing blanket 2 which interacts with the threaded portion 40 of the connecting element 39. The nut element may also be a loose eleven 41 which is not fixed to the second end cap 4 so that only the nut eleven 41 is screwed to the threaded portion 40 of the connecting element 39. The nut element 41 may comprise a handle for tigthening the end caps 3 and 4 against the tubular printing blanket 2.

What is claimed is:

1. Apparatus for cleaning a tubular printing blanket, comprising:

a first end cap, said first end cap mounted to a first end portion of the tubular printing blanket, a second end cap, said second end cap mounted to a second end portion of the tubular printing blanket, a compressed air inlet passing through the first end cap, compressed air supply coupled to the compressed air inlet, said compressed air supply supplying compressed air to an inside of the tubular printing blanket for stiffening the tubular printing blanket during a cleaning operation, and a cleaning element, said cleaning element interacting with an outside surface of the tubular printing blanket, for cleaning the tubular printing blanket.

2. Apparatus according to claim 2, wherein the cleaning element is a rotating brush.

3. Apparatus according to claim 2, wherein the brush is rotated by a drive motor.

4. Apparatus according to claim 1, wherein the first end cap and the second end cap are rotatably supported and one of the first end cap and the second end cap is driven by a drive motor.

5. Apparatus according to claim 1, further comprising at least one cleaning solution applicator for applying cleaning solution to the tubular printing blanket.

6. Apparatus according to claim 5, further comprising a waste collector disposed below the tubular printing blanket and the rotating brush for receiving the cleaning solution.

7. Apparatus according to claim 6, further comprising a filter and treatment device for receiving the cleaning solution and selectively guiding the cleaning solution back to said cleaning solution applicator.

8. Apparatus according to claim 1, further comprising a biasing element for biasing the first end cap and the second end cap against the associated first end portion and second end portion of the tubular printing blanket.

9. Apparatus according to claim 8, wherein the biasing element includes a connecting element extending from the first end cap to the second end cap, said connecting element including a threaded portion, the threaded portion interacting with a nut element formed at one of the first or second end caps, for clamping the first and the second end cap to the associated end portions of the tubular printing blanket.

10. Apparatus according to claim 1, further comprising a sealing element, located at the first end cap and the second end cap, for sealing the inside of the tubular printing blanket against ambient air.

11. Method for cleaning a tubular printing blanket comprising the steps of:

mounting end caps to end portions of the tubular printing blanket for sealing an inside of the tubular printing blanket against ambient air;

supplying compress air to the inside of the tubular printing blanket for stiffening the tubular printing blanket; and cleaning an outside surface of the tubular printing blanket.

* * * * *